United States Patent [19]

Annis et al.

[11] Patent Number: 5,020,399

[45] Date of Patent: Jun. 4, 1991

[54] SELF-ADJUSTING PLIERS WITH CURVED HANDLES

[75] Inventors: Jeffrey R. Annis, Waukesha; Daniel M. Eggert, Kenosha, both of Wis.

[73] Assignee: Snap-On Tools Corporation, Kenosha, Wis.

[21] Appl. No.: 491,957

[22] Filed: Mar. 12, 1990

[51] Int. Cl.[5] ..... B25B 7/12

[52] U.S. Cl. ..... 81/358; 81/409; 81/416; 81/405

[58] Field of Search ..... 81/358, 405, 407–409.5, 81/415–417, 357

[56] References Cited

U.S. PATENT DOCUMENTS

| | | | |
|---|---|---|---|
| D. 142,867 | 11/1945 | Johnson, Jr. . | |
| D. 142,888 | 11/1945 | Miller . | |
| D. 172,591 | 7/1954 | Gauthier . | |
| D. 255,980 | 7/1980 | Winget . | |
| D. 272,984 | 3/1984 | Shaffer . | |
| D. 276,880 | 12/1984 | Tozaburo . | |
| 378,585 | 2/1888 | Gibson . | |
| 2,488,484 | 11/1949 | Vander Clute . | |
| 2,531,285 | 11/1950 | Manspeaker . | |
| 2,913,943 | 11/1959 | Carlson et al. . | |
| 2,954,606 | 10/1960 | Peak . | |
| 3,142,212 | 7/1964 | Grape . | |
| 4,651,598 | 3/1987 | Warheit . | |
| 4,662,252 | 5/1987 | Warheit . | |
| 4,802,390 | 2/1989 | Warheit . | |
| 4,893,530 | 1/1990 | Warheit . | |
| 4,922,770 | 5/1990 | Dlugolecki et al. | 81/357 |

FOREIGN PATENT DOCUMENTS 969920 7/1958 Fed. Rep. of Germany .

OTHER PUBLICATIONS

"Ergonomic Principles in the Design of Hand Tools", T. M. Fraser, 1980, pp. 53–59.

Swanstrom Tools Catalog No. 2, Jul. 1, 1985, cover and p. 5.

Production Engineering, vol. 29, No. 5, May 1982, p. 62.

Photograph of Klein and Erem handles.

Jensen Fall Catalog 1977, p. 91.

Assembly Engineering, Jan., 1985, p. 65.

*Primary Examiner*—James G. Smith

*Attorney, Agent, or Firm*—Emrich & Dithmar

[57] ABSTRACT

Self-adjusting pliers for single-handed manual manipulation will automatically adjust to positions of positive gripping and holding of any size workpiece within the size range defined by the maximum opening between the jaw portions of the pliers, which jaw portions respectively extend parallel to jaw portion axes. Upon closure from the maximum opening, parts first undergo a sliding action along an axis until the workpiece is engaged and then a pivoting action. The plier handles have bearing surfaces inclined at angles in predetermined ranges to the sliding axis and to the jaw portion axes to facilitate shifting from the sliding action to the pivoting action.

20 Claims, 2 Drawing Sheets

SELF-ADJUSTING PLIERS WITH CURVED HANDLES

BACKGROUND OF THE INVENTION

1. Field of the Invention

The invention relates to utility pliers of the self-adjusting type. Such pliers are similar to the channel type but have the capability that, by means of a single-handed manipulation by the user, they will automatically adjust the distance between the gripping jaws in relation to the size of the workpiece to be gripped.

2. Description of the Prior Art

Self-adjusting pliers are disclosed in U.S. Pat. Nos. 4,893,530, 4,802,390, 4,662,252 and 4,651,598. These pliers include two handle members, each having a jaw portion, a neck portion and a handle portion, with the handle members being interconnected at the neck portions and at the handle portions. More specifically, a pawl is fixed to one neck portion and slidably moves in an elongated slot in the other neck portion for engagement with a rack formed in the slot. A coupling link or lever interconnects the handle portions, being pivoted at one end to one handle portion and being slidably movable in a slot in the other handle portion, the coupling link being biased to hold the jaws in a fully open position and to hold the pawl out of engagement with the rack.

When the pliers are used to engage a workpiece, during an initial closing action of the handle members, they will pivot about the pivoted end of the coupling link to close the jaws with the pawl sliding freely along the rack slot. When the jaws engage the workpiece continued closing action of the handle portions will move the pawl into engagement with the rack. This stops the sliding movement of the pawl along the rack slot, and the handle members will then tend to pivot about the pawl. Continued closing action of the handle members will cause the free end of the coupling link to slide in the slot of the adjacent handle portion.

These prior self-adjusting pliers have substantially straight handle portions, and it has been found that, in use, the pawl will not consistently engage with the rack when the jaws engage the workpiece because the handle angles do not permit an alignment of forces suitable for ensuring consistent proper operation. This is particularly true when the pliers are used in an upside down position, i.e., when the pliers are reversed in the user's hand so that the fingers grip the handle member carrying the pawl and the thumb engages the handle member carrying the rack, instead of vice versa. In the case of non-engagement, the handle members will slip relative to one another and the jaws will not firmly hold the workpiece.

SUMMARY OF THE INVENTION

It is a general object of the present invention to provide an improved self-adjusting pliers which avoids the disadvantages of prior constructions while affording additional structural and operating advantages.

An important feature of the invention is the provision of a self-adjusting pliers which ensures consistent firm gripping of a workpiece irrespective of the way the pliers are gripped by the user.

In connection with the foregoing feature, another feature of the invention is the provision of a self-adjusting pliers of the type set forth, which assures consistent engagement of the pawl and rack when the jaws engage the workpiece.

Another feature of the invention is the provision of a self-adjusting pliers of the type set forth, wherein the handle portions are configured so as to optimize the component of forces in the pawl-and-rack-engaging direction.

In connection with the foregoing feature, another feature of the invention is the provision of self-adjusting pliers of the type set forth, which provides curved handle portions with uniquely inclined bearing surfaces engageable with the hand of the user.

These and other features of the invention are attained by providing in self-adjusting pliers including two elongated handle members having opposed respective jaw portions and handle portions, and means interconnecting the handle members so that an initial manual closing action of the handle members when they are in a normally open condition causes a point on one handle member to move slidably with respect to the other handle member along a sliding axis for moving the jaw portions toward each other to grip a workpiece, and then a further manual closing action of the handle members halts the sliding movement and causes the handle members to pivot relative to each other about the point, the improvement comprising: the handle portion of one of the handle members including a bearing surface engageable with the hand of a user and extending at an angle with respect to the sliding axis in the range of from about +30 degrees to about −30 degrees.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figures 1, 2, 3, 4, 5:
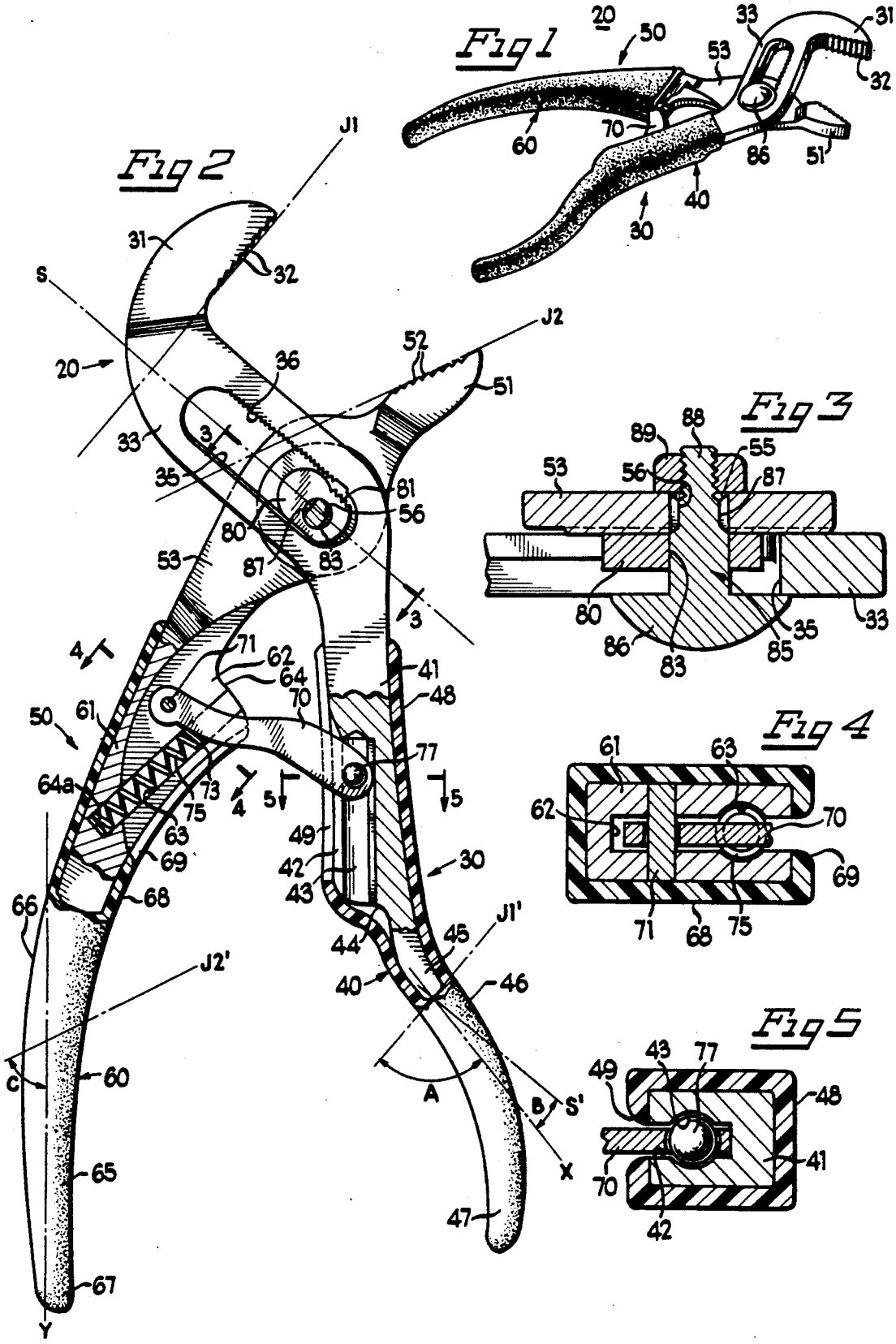
FIG. 1 is a perspective view of a self-adjusting pliers constructed in accordance with and embodying the features of a first embodiment of the present invention, illustrated in their normal fully-open condition.
FIG. 2 is an enlarged, top plan view of the pliers of FIG. 1, in partial section and with portions broken away to more clearly illustrate the internal construction.
FIG. 3 is a further enlarged, fragmentary view in vertical section taken along the line 3—3 in FIG. 2.
FIG. 4 is a further enlarged, fragmentary view in vertical section taken along the line 4—4 in FIG. 2.
FIG. 5 is a further enlarged, fragmentary view in vertical section taken along the line 5—5 in FIG. 2.
Figure 6:
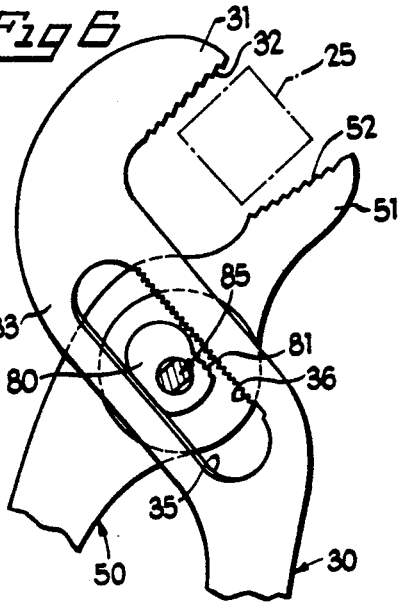
FIG. 6 is a fragmentary view, similar to FIG. 2, illustrating the pliers in a partially closed condition relative to an associated workpiece.
Figure 7:
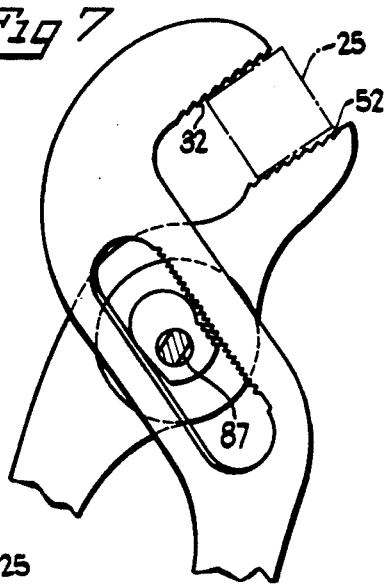
FIG. 7 is a view similar to FIG. 6, illustrating the pliers in a further closed condition with the jaws just engaging the workpiece.
Figure 8:
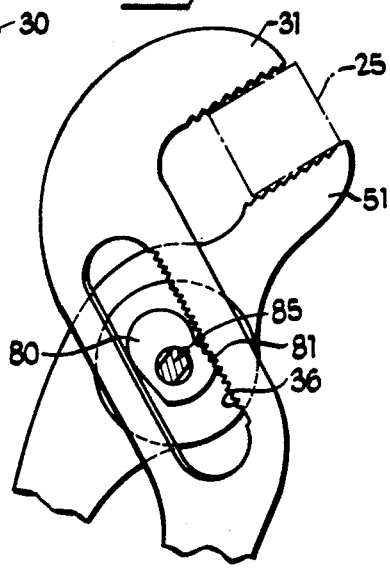
FIG. 8 is a view similar to FIG. 7, illustrating the engagement of the pawl and rack.

Referring to FIGS. 1 and 2 of the drawings, there is illustrated a utility pliers 20 of the self-adjusting type for automatically adjusting to the size of an associated workpiece 25 (see FIGS. 6–8). The pliers 20 includes two rigid, elongated handle members 30 and 50, preferably formed of steel and interconnected in a known configuration to provide for single-handed operation by a user.

Referring now also to FIGS. 3 and 5, the handle member 30 includes a jaw portion 31 having a row of teeth 32 and extending in the direction of a jaw portion axis J1. Integral with the jaw portion 31 at one end thereof and extending therefrom is a neck portion 33 having an elongated, oval slot or channel 35 formed therethrough with a longitudinal slot or sliding axis S which, in the preferred embodiment of the invention, is disposed substantially perpendicular to the jaw portion axis J1. Formed along the side of the slot 35 toward the jaw portion 31 is a rack 36.

Integral with the neck portion 33 and extending therefrom at the opposite end of the slot 35 from the jaw portion 31 is an elongated handle portion 40 and, in particular, a coupling section 41 thereof. Formed in the inner side edge of the coupling section 41 is an elongated slot 42 having an enlarged part-cylindrical portion 43 extending the length thereof and having one end opening onto a shoulder 44 of the coupling section 41. Integral with the coupling section 41 and projecting therefrom is an inclined section 45 having a bearing surface 46 on the outer side thereof, the inclined section 45 and the bearing surface 46 extending along an axis X inclined at a predetermined angle A with respect to the jaw portion axis J1 and at an angle B with respect to the slot axis S (illustrated in FIG. 2 by lines J1′ and S′, respectively parallel to the jaw portion axis J1 and the slot axis S).

Integral with the inclined section 45 and extending outwardly therefrom is a recurved section 47. In use, a sleeve 48 covers the handle portion 40 and has a slot 49 therein aligned with the slot 42 to provide access thereto. The sleeve 48 is preferably formed of a suitable plastic to facilitate gripping of the handle portion 40 and to provide user comfort.

Referring now also to FIGS. 3 and 4, the handle member 50 has a jaw portion 51 provided with teeth 52 and extending along a jaw portion axis J2. Integral with the jaw portion 51 is an enlarged neck portion 53 of reduced thickness having a bore 55 formed therethrough provided with a pair of opposed flat sides 56.

Integral with the neck portion 53 is an elongated handle portion 60 and, in particular, a coupling section 61 thereof. Formed in the inner side of the coupling section 61 is a slot 62 having an enlarged, part-cylindrical portion 63 extending the length thereof and having one end thereof opening onto a shoulder 64 on the coupling section 61 and having the other end thereof closed at a bore end 64*a*. Integral with the coupling section 61 and extending therefrom is an inclined section 65 having a bearing surface 66 on the outer side thereof, the inclined section 65 and the bearing surface 66 extending parallel to an axis Y inclined at an angle C with respect to the jaw portion axis J2 (indicated in FIG. 2 by a line J2′ parallel to the jaw portion axis J2).

Integral with the inclined section 65 at the distal end thereof and projecting therefrom is an end section 67, which may be inclined with respect to the inclined section 65 toward the other handle member 30. In use, the handle portion 60 is preferably covered with a sleeve 68 having a slot 69 therein aligned with the slot 62 to provide access thereto. Preferably the sleeve 68 is formed of the same material as the sleeve 48, and serves the same purpose.

The handle members 30 and 50 are interconnected by an elongated coupling link 70, having one end thereof disposed in the slot 62 in the handle portion 60 and pivotally coupled thereto by a pivot pin 71. The coupling link 70 has a bearing surface 73 adjacent to the pivot pin 71 which is disposed for engagement with a helical compression spring 75 seated in the part-cylindrical portion 63 of the slot 62. The spring 75 resiliently biases the coupling link 70 toward rotation in a counterclockwise direction about the pivot pin 71, as viewed in FIG. 2. The other end of the coupling link 70 extends into the slot 42 in the handle portion 40 for sliding engagement therein and carries a ball 77 disposed in the part-cylindrical portion 43 of the slot 42 for retaining the coupling link 70 in the slot 42. It will be appreciated that, in assembly of the pliers 20, the open ends of the part-cylindrical portions 43 and 63 of the slots 42 and 62, respectively, permit insertion of the ball 77 and the spring 75, respectively.

The handle members 30 and 50 are assembled with the neck portions 33 and 53 thereof overlapping, the reduced thickness of the neck portion 53 accommodating the neck portion 33. A pawl 80 is disposed in the slot 35 and rests upon the neck portion 53, the pawl 80 having teeth 81 facing the rack 36. However, the width of the pawl 80 is less than the width of the slot 35 to accommodate free sliding movement of the pawl 80 along the slot 35. The pawl 80 has a bore 83 therethrough disposed in alignment with the bore 55 in the neck portion 53 and receiving therethrough a bolt 85 having an enlarged head 86 with a diameter greater than the width of the slot 35 and resting in use on the outer surface of the neck portion 33 (see FIGS. 1 and 3). The shank of the bolt 85 has a flattened portion 87 which matingly engages with the flat sides 56 of the bore 55 to prevent rotational movement of the bolt 85 with respect to the handle member 50. The bolt 85 has a reduced-diameter, externally threaded end 88, which projects beyond the neck portion 53 and is engageable with an associated nut 89 to hold the parts in their assembled condition. It will be appreciated that the cooperation of the flattened portion 87 of the bolt 85 with the flat sides 56 of the bore 55 also serves to prevent clamping of the handle members 30 and 50 together when the nut 89 is tightened, thereby ensuring free sliding movement of the parts in operation.

Referring now also to FIGS. 6–8, the operation of the pliers 20 will be explained. It will be appreciated that the biasing action of the spring 75 against the coupling link 70 holds the ball end of the coupling link 70 against the upper or neck end of the slot 42 and resiliently urges the handle member 30 toward rotation in a counterclockwise direction about the axis of the pivot pin 71.

This serves to hold the pliers 20 in a normal, fully-open configuration illustrated in FIG. 2, and also serves to hold the lower edge of the slot 35 in engagement with the pawl 80 to maintain a gap between the pawl teeth 81 and the rack 36.

When the user wishes to grip a workpiece 25, he grasps the handle portions 40 and 60 in one hand, with the fingers wrapped around the outer side of one handle portion (typically the handle portion 40) and the other handle portion disposed against the palm of the user's hand. As the user initially squeezes the handle portions 40 and 60 toward each other, they pivot about the axis of the pivot pin 71, causing the jaw portions 31 and 51 to move toward each other, with the pawl 80 sliding freely along the slot 35 (see FIG. 6) until the jaw portions 31 and 51 engage the workpiece 25 (FIG. 7). At this point, further closure of the jaw portions 31 and 51 is prevented, and as the user continues to squeeze the handle portions 40 and 60 together they translate relative to each other so that the teeth 81 of the pawl 80 are moved into engagement with the rack 36 (FIG. 8), tilting the pawl 80 slightly in the process, thereby preventing any further sliding movement of the rack 80 along the slot 35. Once the pawl 80 has engaged the rack 36, the handle portions 40 and 60 can no longer pivot about the axis of the pivot pin 71. Thus, any further closing action of the handle portions 40 and 60 will tend to pivot the handle members 30 and 50 with respect to each other about the axis of the bolt 85 for firmly gripping the workpiece 25. Then, the ball end of the coupling link 70 overcomes the friction in the slot 42 and begins to slide down the slot 42.

It is a fundamental aspect of the present invention that it ensures consistent engagement of the pawl 80 with the rack 36, thereby to ensure consistent firm gripping of the workpiece 25, irrespective of the manner in which the pliers 20 are gripped by the user. As explained above, in prior self-adjusting pliers, this pawl and rack engagement was not consistently achieved in all circumstances, particularly when the pliers were reversed in the user's hand, so that the fingers gripped the handle portion 60 instead of the handle portion 40. In the present invention, by proper design of the handle portions 40 and 60, an optimum distribution of forces can be achieved to ensure consistent engagement of the pawl 80 with the rack 36 irrespective of the way the pliers are held by the user.

More specifically, the inclined sections 45 and 65 of the handle portions 40 and 60 are provided at angles of inclination more nearly parallel to the slot axis S than in the prior art pliers, thereby to ensure that a greater component of the closing force manually applied by the user to the handle portions 40 and 60 will be in a direction substantially perpendicular to the slot axis S, i.e., in the direction of engagement of the pawl 80 with the rack 36. Furthermore, the range of inclination angles which will achieve the desired result has been determined. Thus, it can be seen that the inclined sections 45 and 65 and the bearing surfaces 46 and 66 thereof are disposed parallel to axes X and Y, respectively, which are inclined with respect to the coupling sections 41 and 61 toward the slot axis S. Thus, for example, the inclined section 45 is inclined at an angle B with respect to the slot axis S, which is substantially smaller than the inclination of the prior art handle portion with respect to that slot axis. It follows that the inclination of the inclined section 45 will be at an angle A with respect to the jaw portion axis J1, which is substantially greater than in the prior pliers. It will be appreciated that, in the preferred embodiment, where the axes S and J1 are perpendicular to each other, the angles A and B will be complementary, but this is not essential.

While it has been found that the desired improved results can be achieved if either one of the handle portions 40 and 60 is provided with the inclined section, optimum results are achieved when it is provided on both handle portions. Thus, the handle portion 60 has an inclined section 65 which extends along an axis Y inclined with respect to the jaw portion axis J2 at an angle C, which is greater than in the prior pliers. Since the orientation of the slot axis S with respect to the handle member 50 changes as the pliers 20 are closed, there has been selected, as a reference, a condition wherein the pliers 20 are closed to the point where the jaw portion axes J1 and J2 are substantially parallel to each other (very nearly the condition of FIG. 8), so that the jaw portions 31 and 51 define a common jaw axis. It will be appreciated that, in this condition of the preferred embodiment of the pliers illustrated in FIG. 2, the axis Y of the inclined section 65 will be disposed at an angle with respect to the slot axis S which is the complement of the angle C, i.e., at the angle B in the case where A=C. In other conditions the angle of the axis Y to the slot axis S will be greater than or less than B.

Figure 9:
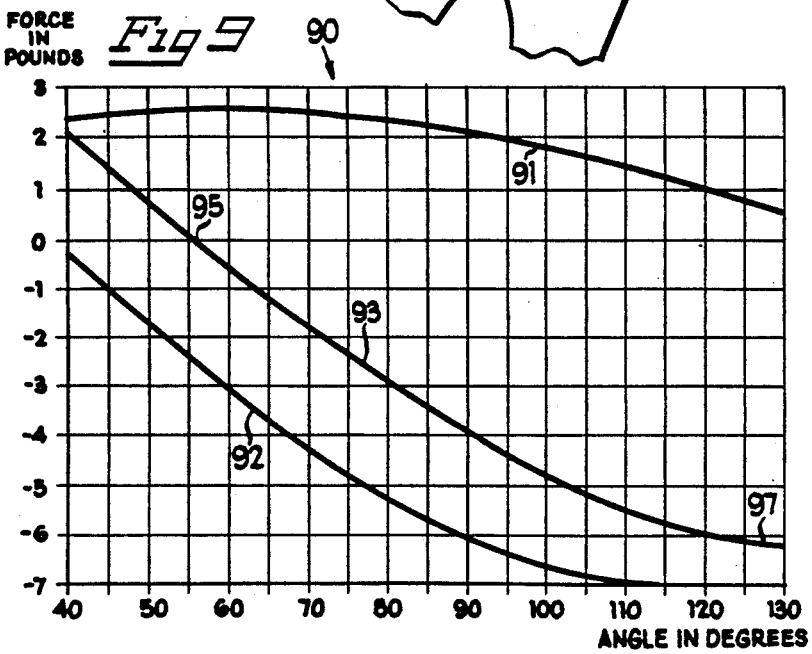
FIG. 9 is a graph of the angle of inclination of the handle bearing surfaces against force for the frictional force of the pliers, the force applied to the handle portions and the sum of those forces to illustrate the operable range of angles.

Referring to FIG. 9, there is a graph 90 of the handle angles A or C plotted against force. Curve 91 represents the frictional force that exists between the workpiece 25 and the jaw 51, calculated by utilizing the coefficient of friction for steel and the clamping force on the workpiece at which the pawl and rack engagement is desired to occur, which has been found to be about 8 pounds. This is the force which resists engagement of the pawl 80 with the rack 36, since that engagement requires that the jaws 31 and 51 translate with respect to each other. Curve 92 is the resultant of opposing forces applied by the user to overcome that frictional force and move the pawl into engagement with the rack, i.e., the forces applied by the user to the handle portions 40 and 60 and the force applied by the spring 75. Curve 93 is the algebraic sum of curves 91 and 92. It will be appreciated that this algebraic sum must be less than or equal to zero to overcome the frictional force and cause the pawl 80 and the rack 36 to engage.

It can be seen that if the angle A or C is 40° the frictional force (curve 91) is greater than two pounds and the resultant of the opposing forces (curve 92) is less than one pound. Accordingly, it is insufficient to overcome the frictional force and will be inadequate to cause engagement of the pawl 80 with the rack 36. Thus, the sum of these two forces is about two pounds, indicated on curve 93. It will be appreciated that the cut-off point wherein the applied force begins to overcome the frictional force is where the curve 93, representing the algebraic sum of forces, is zero, at point 95, which occurs at a handle angle of about 56°. Thus, theoretically, at angles greater than 56° engagement of the pawl 80 with the rack 36 should be ensured.

It can be seen that the curve 93 slopes downwardly to the right, so that as the angle increases the performance steadily improves with the pawl-engaging force exceeding the frictional force by a greater and greater amount. This improvement continues to about a handle angle of 130°, at which point the curve 93 starts to level off at 97. Below an angle of 56°, the pliers 20 will not work consistently. They will still work some of the time, because the user's hand does not apply perfectly perpendicular forces. Because of the variability in the application of forces by the user's hand, the pliers may also sometimes work inconsistently at handle angles of 56° or slightly above. Thus, in order to ensure consistent operation, the handle angle A or C should be at least 60° or greater. While, theoretically, the pliers 20 will work well with handle angles A or C of 130° and above, as a practical matter the upper limit of the angle is about 120° because of limitations in the possible physical locations of the handles. In the preferred embodiment of the invention, the handle angle A or C is about 70° and, since the angles A and B are complementary in this embodiment, the angle B is about 20°. This value for the angles A and C has been found to be great enough to ensure consistent operation and yet small enough to ensure comfort and ease of use, since it has been found that at large angles the pliers may become uncomfortable to use or awkward to operate in close quarters.

Figure 10:
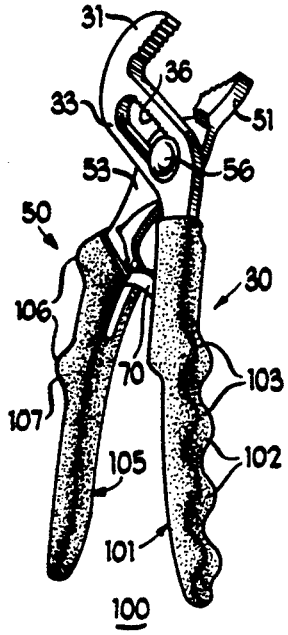
FIG. 10 is a perspective view, similar to FIG. 1, of self-adjusting pliers in accordance with a second embodiment of the present invention.

Referring to FIG. 10, there is illustrated an alternative embodiment of the present invention, generally designated by the numeral 100. The pliers 100 are substantially the same as the pliers 20, except for the handle portions and, accordingly, like portions of the pliers 20 and 100 bear the same reference numbers. The handle member 30 of the pliers 100 include a handle portion 101 which is substantially straight and which is provided on the outer edge thereof with a plurality of projections 102, each provided with a leading bearing surface 103. The handle member 50 of the pliers 100 has a handle portion 105 which is also substantially straight and has on the outer side thereof projections 106, each having a trailing bearing surface 107. The handle portions 101 and 105 are configured so that the longitudinal axes thereof define angles analogous to the angles A and C, but which are less than 60°, and analogous to the angle B, but which are greater than 35°. However, each of the bearing surfaces 103 and 107 is disposed at an angle with respect to the jaw portion axis of the corresponding handle member of between 60° and 120°, and at an angle with respect to the slot axis of between +35° and −30°, when the pliers 100 are configured with the jaw portions 31 and 51 substantially parallel to each other.

In use, the user grips the pliers 100 with his fingers engaging the bearing surfaces 103 and his thumb engaging one of the bearing surfaces 107. Thus, as the pliers 100 are closed, the handle portion 101 is pulled generally downwardly and the handle portion 105 is pushed generally upwardly, as viewed in FIG. 10, to ensure consistent engagement of the pawl with the rack 36.

In the disclosed embodiments, both of the handle members 30 and 50 are either curved so as to be provided with the inclined bearing surfaces 46 and 66, or provided with projections having bearing surfaces 103 and 107. But it will be appreciated that the invention will operate if only one of the handle members is provided with these bearing surfaces. Also, while in the preferred embodiment each of the handle members has bearing surfaces disposed at substantially the same handle angles, this is not essential for effective operation, as long as the bearing surfaces are disposed at angles which fall within the requisite ranges. Finally, while in the preferred embodiment the slot axis S is disposed substantially perpendicular to the jaw portion axis J1, this is not critical.

From the foregoing, it can be seen that there has been provided an improved self-adjusting pliers which is of simple and economical construction and which has handle portions configured so as to ensure consistent engagement of the rack and pawl.

We claim:

1. In self-adjusting pliers including two elongated handle members having opposed respective jaw portions and handle portions, and means interconnecting the handle members so that an initial manual closing action of the handle members when they are in a normally open condition causes a point on one handle member to move slidably with respect to the other handle member along a sliding axis for moving the jaw portions toward each other to grip a workpiece, and then a further manual closing action of the handle members halts the sliding movement and causes the handle members to pivot relative to each other about the point, the improvement comprising: the handle portion of one of the handle members including an inclined section engageable with the hand of a user and extending at an angle with respect to the sliding axis in the range of from about +30 degrees to about −30 degrees.

2. The pliers of claim 1, wherein said sliding axis is disposed on said one handle member.

3. The pliers of claim 1, wherein said included section is disposed intermediate the ends of the handle portion.

4. The pliers of claim 1, wherein said angle is substantially +20 degrees.

5. The pliers of claim 1, wherein the handle portion of the other of said handle members includes an inclined section engageable with the hand of the user and extending at an angle with respect to the sliding axis in the range of from about +35 degrees to about −30 degrees when the handle members are disposed in a predetermined condition such that both jaw portions extend parallel to a common axis.

6. In self-adjusting pliers including two elongated handle members having opposed respective jaw portions and handle portions, with each jaw portion extending along an axis, and means interconnecting the handle members so that an initial manual closing action thereof when in a normally open condition causes the jaw portions to move toward each other in a sliding action to grip a workpiece, and then a further manual closing action of the handle members halts the sliding action and causes the handle members to pivot relative to each other, the improvement comprising: the handle portion of at least one of the handle members having an inclined section engageable with the hand of a user and extending at an angle with respect to the axis of the jaw portion of that handle member in the range of from about 60 degrees to about 120 degrees.

7. The pliers of claim 6, wherein said inclined section is disposed intermediate the ends of the handle portion of said at least one handle member.

8. The pliers of claim 6, wherein the angle of said inclined section is substantially 70 degrees.

9. The pliers of claim 6, wherein each of said handle members has an inclined section extending at an angle with respect to the axis of the jaw portion of that handle member in the range of from about 60 degrees to about 120 degrees.

10. The pliers of claim 6, and further comprising a coupling link interconnecting the handle portions of the handle members, and bias means cooperating with said coupling link for resiliently urging the handle members to a fully open condition.

11. The pliers of claim 10, wherein said coupling link is pivotally movable with respect to a first one of the handle members, said bias means being disposed on said first one of the handle members.

12. The pliers of claim 11, wherein said coupling link is slidably movable with respect to a second one of the handle members.

13. The pliers of claim 6, wherein the sliding action of the jaw portions toward each other is along a sliding axis, said sliding axis being disposed substantially perpendicular to the axis of one of said jaw portions.

14. In self-adjusting pliers including two elongated handle members having opposed respective jaw portions and handle portions, with each jaw portion extending along an axis, and means interconnecting the handle members so that an initial manual closing action thereof when in a normally open condition causes the jaw portions to move toward each other in a sliding action to grip a workpiece, and then a further manual closing action of the handle members halts the sliding action and causes the handle members to pivot relative to each other, the improvement comprising: the handle portion of each of the handle members including a bearing surface engageable with the hand of a user and extending at an angle with respect to the axis of the jaw portion of that handle member in the range of from about 60 degrees to about 120 degrees.

15. The pliers of claim 14, wherein each of the handle members includes an inclined section extending at an angle with respect to the axis of the jaw portion of that handle member in the range of from about 60 degrees to about 120 degrees, said bearing surfaces being respectively disposed on said inclined sections.

16. The pliers of claim 14, wherein each of the handle portions has a projection extending therefrom, said bearing surfaces being respectively disposed on said projections.

17. The pliers of claim 16, wherein each handle portion has a plurality of projections extending therefrom, and a plurality of said bearing surfaces on each handle portion respectively disposed on said projections.

18. The pliers of claim 14, wherein the sliding action of the jaw portions toward each other is along a sliding axis, each of said bearing surfaces extending at an angle with respect to the sliding axis in the range of from about +35 to about −30 degrees in a predetermined condition of the handle members relative to each other wherein the axes of the jaw portions extend substantially parallel to each other.

19. The pliers of claim 18, wherein said bearing surface on one of the handle members is disposed at said angle with respect to the sliding axis in all conditions of the handle members relative to each other.

20. The pliers of claim 18, wherein said sliding axis is disposed substantially perpendicular to the jaw portion axes in said predetermined condition.

* * * * *